US005367721A

United States Patent [19]

Boyles

[11] Patent Number: 5,367,721

[45] Date of Patent: Nov. 29, 1994

[54] LIFT APPARATUS AND METHOD FOR TRANSPORTING A PASSENGER INTO AND OUT OF A SWIMMING POOL

[75] Inventor: Mark J. Boyles, Daphne, Ala.

[73] Assignee: BioCare Laboratories, Inc., Daphne, Ala.

[21] Appl. No.: 133,926

[22] Filed: Oct. 12, 1993

[51] Int. Cl.[5] ..... E04H 4/14

[52] U.S. Cl. ..... 4/496; 4/561.1; 4/560.1; 5/81.1

[58] Field of Search ..... 4/496, 560.1, 561.1, 4/562.1, 563.1, 564.1, 565.1, 566.1; 212/232, 237; 114/370, 371; 414/921, 680; 5/81.1, 83.1, 86.1, 87.1

[56] References Cited

U.S. PATENT DOCUMENTS

| | | | |
|---|---|---|---|
| D. 285,137 | 8/1986 | Svensson | 5/81.1 |
| 1,313,404 | 8/1919 | Marten | 114/370 |
| 2,813,277 | 11/1957 | Zillt . | |
| 3,180,622 | 4/1965 | Fillion | 414/680 |
| 3,310,816 | 3/1967 | James et al. | 4/562.1 |
| 3,852,835 | 12/1974 | Whitaker | 4/562.1 |
| 3,981,484 | 9/1976 | James | 4/564.1 |
| 4,183,106 | 1/1980 | Grimes et al. . | |
| 4,221,008 | 9/1980 | Nolan . | |
| 4,554,691 | 11/1985 | Daugherty . | |
| 4,569,091 | 2/1986 | Brandenberger | 4/562.1 |
| 4,606,082 | 8/1986 | Kuhlman . | |
| 4,733,418 | 3/1988 | Luther . | |
| 4,885,810 | 12/1989 | Unger et al. . | |
| 4,905,327 | 3/1990 | Boublil . | |
| 4,928,330 | 3/1990 | Moore . | |
| 4,941,216 | 7/1990 | Boublil . | |
| 4,996,728 | 3/1991 | Nolan | 4/496 |
| 5,077,844 | 1/1992 | Twitchell et al. . | |
| 5,218,727 | 6/1993 | Krumbeck | 4/496 |

FOREIGN PATENT DOCUMENTS

| | | |
|---|---|---|
| 0400664 | 12/1990 | European Pat. Off. . |
| 2477012 | 9/1981 | France . |
| 7603243 | 10/1977 | Netherlands . |

OTHER PUBLICATIONS

Swim-Lift ® II (undated), Spectrum Pool Products.
Econo-Lift TM (undated), Spectrum Pool Products.
Econo-Lift TM (undated), Spectrum Pool Products.
Guardian, Jun. 1992, Guardian Products, Inc.
Swimming Pool Lifter (undated), Ted Hoyer & Company.
Horton Safe Lift (undated), Horton Products Company.
Freedom-Lift (undated), Spectrum Pool Products.

*Primary Examiner*—Henry J. Recla
*Assistant Examiner*—Charles R. Eloshway

[57] ABSTRACT

A lift apparatus for transporting a passenger between positions, such as, a swimming pool deck and a swimming pool, includes a boom having a raised position over the deck and a lower position over the pool. A hinge pivotally mounts one end of the boom at an oblique angle to the pool deck so that the boom is movable in an oblique plane between the raised position over the deck and the lower position over the pool. A seat for supporting the passenger is suspended from the other end of the boom and is at a first position above the deck with the boom in the raised position and at a second position below the deck with the boom in the lower position. A motor-driven gear rack is operatively connected with the boom to reversibly move the boom in the oblique plane between the raised and lower positions to move the seat and passenger in an arc between the first position above the deck and the second position below the deck to transport the passenger between the pool deck and the swimming pool.

20 Claims, 5 Drawing Sheets

LIFT APPARATUS AND METHOD FOR TRANSPORTING A PASSENGER INTO AND OUT OF A SWIMMING POOL

BACKGROUND OF THE INVENTION

1) Field of the Invention

This invention relates to a lift apparatus to be installed on a swimming pool deck adjacent the edge of a swimming pool for transporting a passenger from the pool deck into and out of the swimming pool.

2) Description Of the Prior Art

For individuals with limited mobility, access to a swimming pool is difficult, if not impossible, without some type of mechanical lift assistance. There are a number of apparatus designed to lift and transport a person into and out of a swimming pool. None, however, provide a boom which is pivotally mounted at an oblique angle to the pool deck for movement in an oblique plane between the pool deck and the swimming pool so that a passenger carrier, which is suspended from the boom, sweeps an arc close to the deck and pool to provide a safe and secure apparatus for entering and leaving the pool.

The following are considered representative of prior passenger lift apparatus. In U.S. Pat. No. 4,183,106—Grimes et al, a rotatable and vertically reciprocal chair first rotates from a position over a pool deck to a position over a swimming pool and then descends for passenger entry into the pool. Thus, Grimes requires structure for both rotational and vertical movement of the chair to transport a person into and out of the swimming pool.

U.S. Pat. No. 5,077,844—Twitchell et al discloses a lift apparatus having a boom which is pivotally mounted at one end about a horizontal axis to an upper end of a vertical mast that is rotatable about a vertical axis. A passenger support sling extends from the other end of the boom. Rotation of the mast and pivotal movement of the boom are necessary to move the sling and passenger to a desired position.

U.S. Pat. No. 4,221,008—Nolan is directed to a swimming pool chair lift which has a vertically oriented cam extending from the base of the swimming pool to a pool deck for transporting a chair vertically and in a helical path into and out of the swimming pool. A cam follower is coupled to the chair and follows an upper helical section of the cam to first rotate the chair from the deck to a position over the pool after which the chair drops vertically along the cam into the pool.

Netherlands 7603243 discloses a lift apparatus for transporting a detachable wheelchair into and out of a swimming pool from a pool deck. The lift apparatus has an arm which pivots about a horizontal axis in a vertical plane to raise the wheelchair above the deck and then to lower the wheelchair into the pool. The wheelchair is pivoted in a ferris wheel manner, from a passenger boarding position located a distance from the edge of the pool, through an arc greater than 90°, thus raising the wheelchair and passenger to a vertical height above the deck before entering the pool.

The present invention overcomes the limitations of the prior passenger lift apparatus by pivotally mounting one end of a boom at an oblique angle to the pool deck so that a passenger carrier, which is suspended from the other end of the boom, sweeps an arc in proximity to the deck and the pool as the boom moves in an oblique plane between a raised position over the deck and a lower position over the pool to transport a passenger into and out of the pool.

SUMMARY OF THE INVENTION

An object of the invention is, therefore, to provide a lift apparatus for transporting a passenger between positions, such as, a swimming pool deck and a swimming pool so that the passenger moves in an arc close to the deck and pool at all times during the transporting movement, thus providing a safe and secure access to the pool for an incapacitated person.

In order to achieve this, a lift apparatus is provided having a boom pivotally mounted at an oblique angle to the swimming pool deck and movable in an oblique plane between a raised position over the deck and a lower position over the pool so that a passenger carrier, which is suspended from the boom, sweeps through the arc to transport the passenger between the pool deck and the swimming pool as the boom moves in the oblique plane.

A further object is that the passenger carrier has a seat which remains substantially parallel to the pool deck while moving between the pool deck and the swimming pool.

Another object is that the boom is limited in movement between the raised position over the pool deck and the lower position over the swimming pool.

In accordance with the present invention, there is provided a lift apparatus for transporting a passenger between positions, the lift apparatus including a boom and means for mounting the boom for pivoting movement in a plane oblique to a horizontal plane between a raised position and a lower position, the mounting means having a base. A carrier is suspended from the boom at a point spaced from the mounting means and has a seat for supporting the passenger, the seat being at a first position above the base when the boom is in the raised position and at a second position below the base when the boom is in the lower position. Drive means reversibly moves the boom in the oblique plane between the raised and lower positions to move the seat in an arc between the first and second positions.

A method of transporting a passenger into and out of a swimming pool from a generally horizontal pool deck is provided including the steps of mounting a boom at an oblique angle to the pool deck, and moving the boom in an oblique plane between a raised position overlying the deck and a lower position overlying the pool to move a seat, which is suspended from the boom, in an arc between a first position above the deck and a second position below the deck to transport the passenger between the pool deck and the swimming pool.

It is to be understood that both the foregoing general description and the following detailed description are exemplary and explanatory only and are not restrictive of the invention, as claimed.

The accompanying drawings, which are incorporated in and constitute a part of the specification, illustrate one embodiment of the invention and together with the description, serve to explain the principles of the invention.

BRIEF DESCRIPTION OF THE DRAWINGS

An embodiment of a lift apparatus constructed in accordance with the present invention for transporting a passenger between positions will now be described by way of example only, with reference to the accompanying drawings, in which.

DETAILED DESCRIPTION OF THE PREFERRED EMBODIMENT

Figure 1:
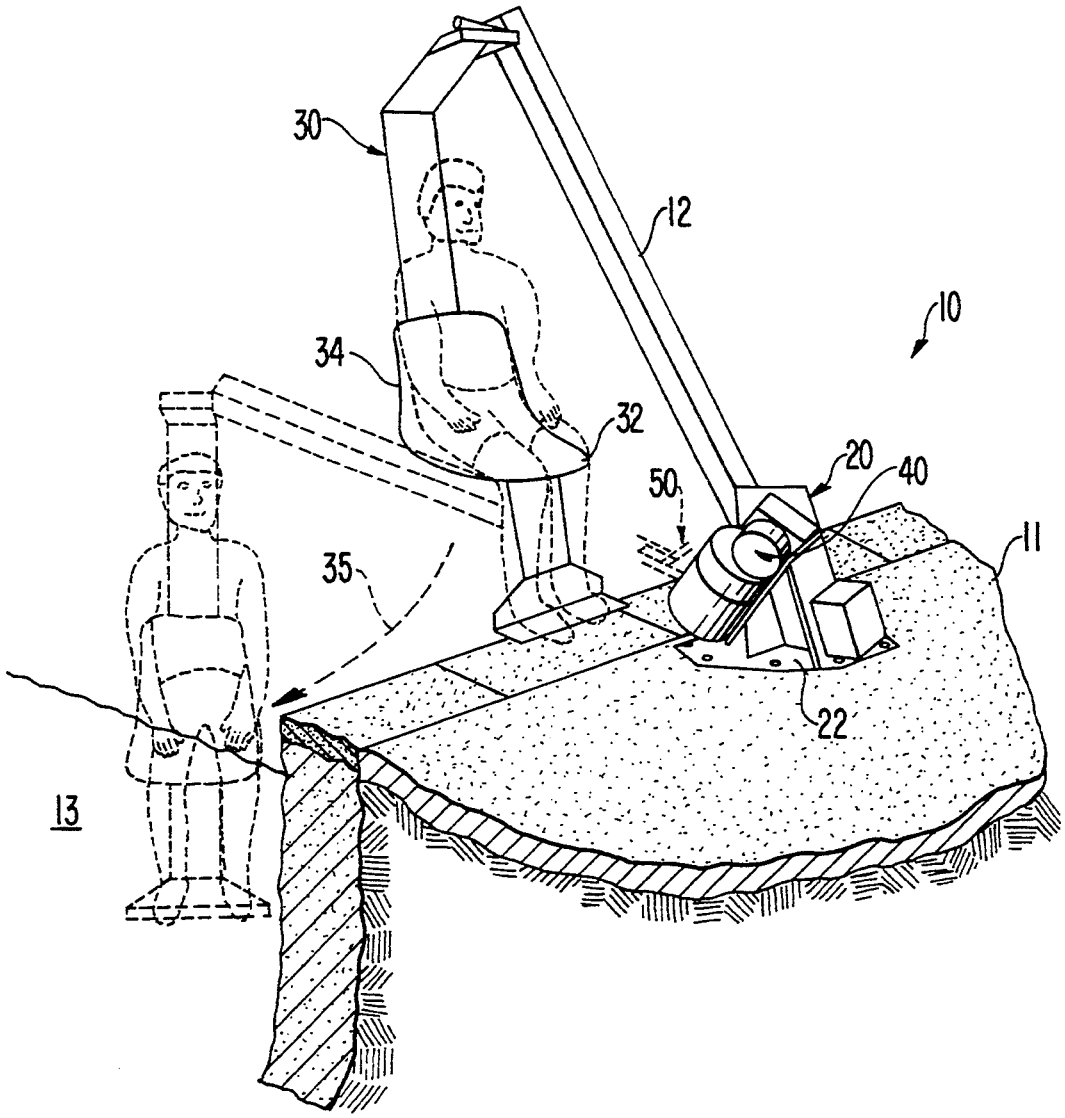
FIG. 1 is a perspective view of the present invention shown attached to a swimming pool deck.

A lift apparatus constructed in accordance with the present invention for transporting a passenger between positions is generally shown at 10. The lift apparatus 10 is particularly useful in transporting a person between a swimming pool deck 11 and a swimming pool 13 as illustrated in FIG. 1 and as described below.

The lift apparatus 10 includes a boom 12 having a raised position, as illustrated, overlying the pool deck 11 and a lower position, shown by the dashed line representation, overlying the pool 13. The pool deck 11 has a generally horizontal surface upon which the lift assembly 10 is secured.

Figure 2:
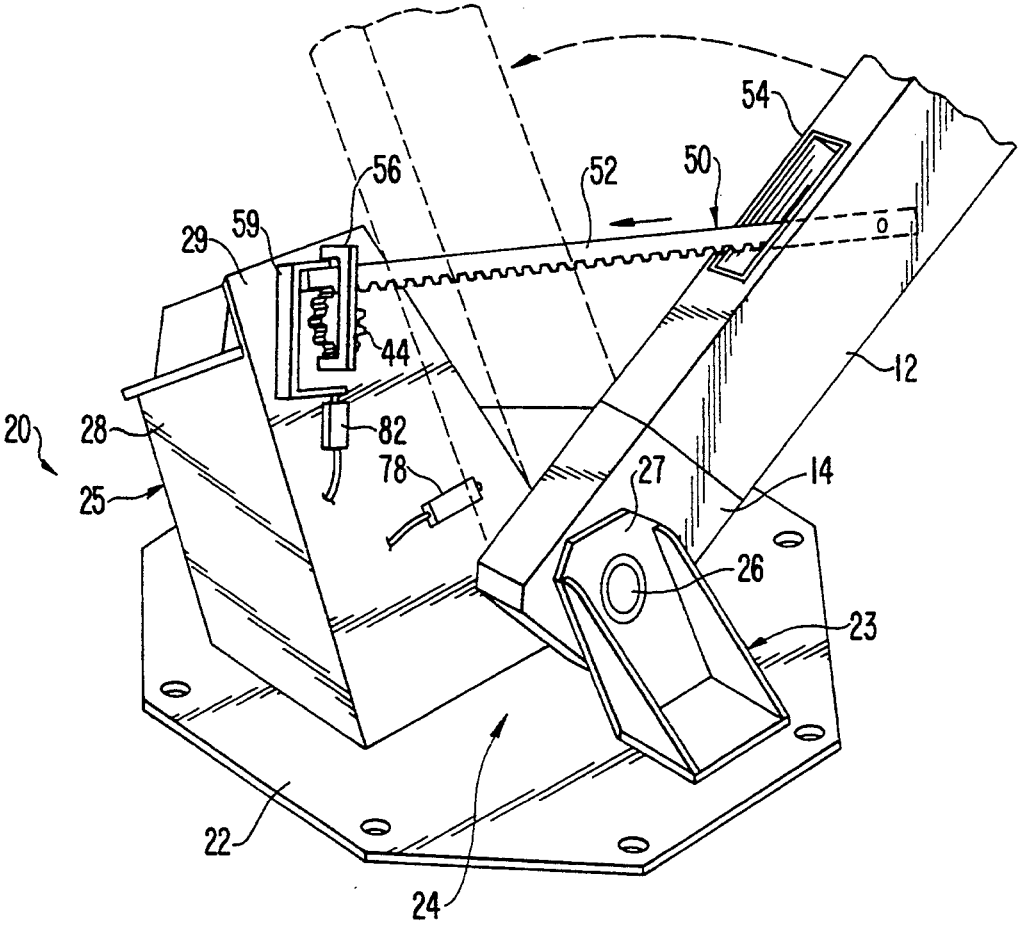
FIG. 2 is an enlarged fragmentary perspective view of the mounting means for the boom.
Figure 3:
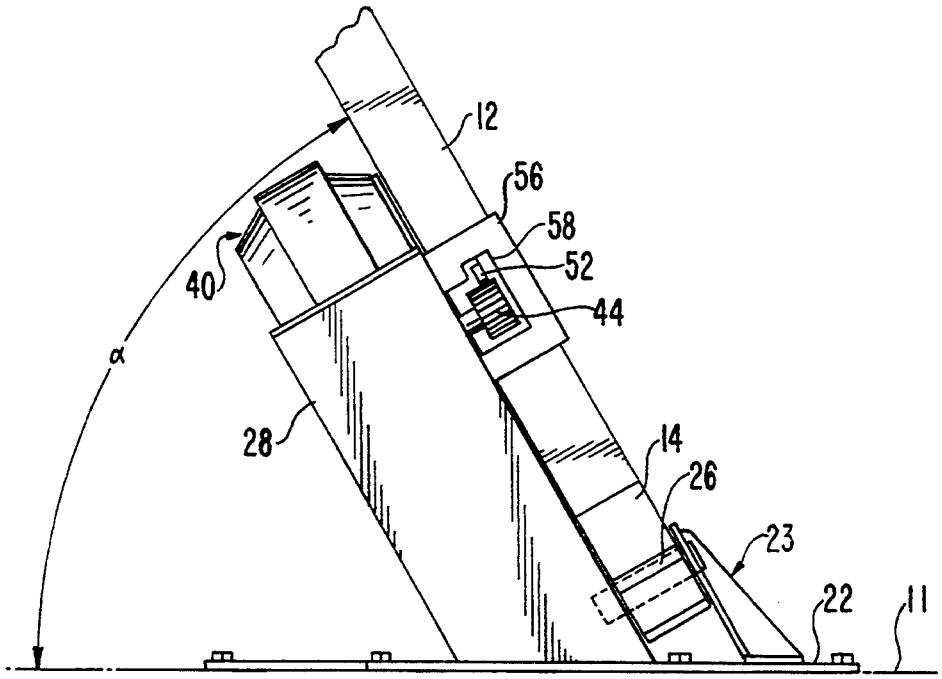
FIG. 3 is a front view of the mounting means of FIG. 2.
Figure 4:
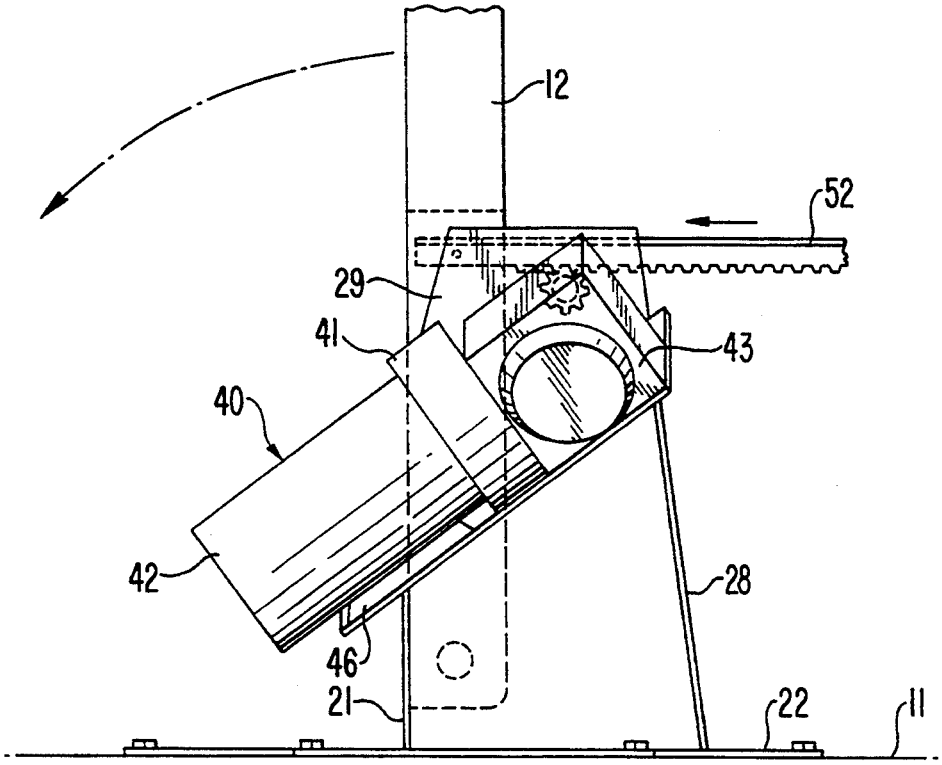
FIG. 4 is a side view of the mounting means of FIG. 2.

With reference to FIGS. 2–4, the lift apparatus 10 also includes mounting means 20 having a planar base 22 for pivotally mounting one end of the boom 12 at an oblique angle $\alpha$ to the base 22 and to the pool deck 11 so that the boom 12 is movable in an oblique plane between the raised and lower positions. The base 22 is rigidly secured to the pool deck 11 by suitable fasteners. The mounting means 20 also includes a hinge 24 which is fixed to the base 22 and has a hinge pin 26 extending at the complementary angle to the oblique angle $\alpha$ and serving as the pivot for the boom 12. The oblique angle $\alpha$ is, as illustrated in FIG. 3, 60° as measured in a clockwise direction from the base 22 to the boom 12. Consequently, the hinge pin 26 extends at the complementary angle of 30° as measured in a counterclockwise direction from the base 22 to the axis of the hinge pin 26. It is to be understood that illustrations are provided, as here, for purposes of example and not limitation. The oblique angle at which the boom 12 is pivotally mounted may be other than 60° as will be apparent from the following description.

The lift apparatus 10 also includes a carrier 30 which is suspended from the boom 12 at a point spaced from the mounting means 20 as shown in FIG. 1. The carrier 30 has a seat 32 and a backrest 34 projecting upwardly from the seat 32 for supporting the passenger in a sitting position. Typically, the seat 32 and the backrest 34 are formed as a unitary molded chair unit. The seat 32 is at a first position, as illustrated, above the base 22 and the pool deck 11 when the boom 12 is in the raised position over the pool deck 11 and at a second position, shown in dotted lines, below the base 22 and the pool deck 11 when the boom 12 is in the lower position over the pool 13.

The lift apparatus 10 further includes drive means 40 mechanically linked with the boom 12 by a gear rack assembly 50 for reversibly moving the boom 12 in the oblique plane between the raised position over the pool deck 11 and the lower position over the pool 13. As the boom 12 moves between the raised and lower positions, the carrier 30 including the seat 32 moves in an arc 35 between the first position above the base 22 and the second position below the base 22. Thus, a person sitting on the seat 32 with the boom 12 in the raised position over the pool deck 11 may be transported into the swimming pool 13 as the seat 32 moves from the first position above the base 22 and the pool deck 11 to the second position below the base 22 and the pool deck 11. The arc 35 through which the chair 32 and the person move is less than 90° which occurs as a result of limiting pivotal movement of the boom 12 about the hinge pin 26 to less than 90° as described in more detail below.

The boom 12 comprises an elongated steel tube having a uniform square cross section along its length to provide opposed sides extending the length of the boom 12. A solid pivot block 14 is inserted within one end of the boom 12 and is secured by welding to the end of the boom 12 for mounting to the hinge pin 26. The end of the boom 12 having the solid pivot block 14 is bored to provide a through hole into which a bushing (not shown) is pressed for receiving the hinge pin 26. The axis of the hinge pin 26 extends perpendicularly to the length of the boom 12.

The hinge 24 includes a first bracket 25 and an opposed second bracket 23 between which the hinge pin 26 is secured. The first bracket 25 has a planar side portion 28 and a planar first pin support portion 29. The first pin support portion 29 extends upwardly from the base 22 at the same angle as the oblique angle $\alpha$ and has a hole, located in a lower corner, through which one end of the hinge pin 26 extends for attachment to the first pin support portion 29 using a suitable fastener. The second bracket 23 includes a planar second pin support portion 27 which is spaced apart from the first pin support portion 29 and extends upwardly from the base 22 at the same angle as the oblique angle $\alpha$. The second pin support portion 27 has a hole opposite the hole of the first pin support portion 29 through which the other end of the hinge pin 26 extends for attachment to the second pin support portion 27 using a suitable fastener. The hinge pin 26 is thus anchored perpendicularly to the first pin support portion 29 of the first bracket 25 and to the second pin support portion 27 of the second bracket 23 so that the hinge pin 26 extends at the complementary angle to the oblique angle $\alpha$. As illustrated, the hinge pin 26 extends at the complementary angle of 30° to the oblique angle of 60° relative to the base 22. The present invention contemplates mounting the boom at oblique angles other than 60°, for example, between 50° and 70° By way of example, if the boom were mounted at an oblique angle of 50° or 70°, the hinge pin 26 would extend, respectively, at the complementary angles of 40° and 20° with respect to the base 22. The mounting means 20 also includes a gusset 21 upstanding from the base 22 and secured by welding to the base 22 and to the rear surface of the first pin support portion 29 for supporting, in conjunction with the side portion 28, the drive means 40 as described below.

The drive means 40 includes a gear drive motor 42 having a drive shaft which is connected through a star coupling 41 to the input shaft of a right angle gear box 43. The gear box 43 has an output shaft, 90° offset from the input shaft, to which a drive gear 44 is connected. The gear drive motor 42 is of the type presently available from Leeson Electric Corporation of Grafton, Wis., model No. 108050 RS56C frame, rated ⅓ hp, 1800 rpm at a nominal 24vDC. The right angle gear box 43 and the star coupling 41 are available as a unit from Reliance Electric Industrial Company, model No. FC56CM12F.

The gear drive motor 42, the star coupling 41 and the gear box 43 are mounted on a planar support plate 46 which extends at an angle to the base 22 adjacent the rear surface of the first pin support portion 29. The support plate 46 is fixed by, e.g., welding to the top edge surfaces of the gusset 21 and the side portion 28. The output shaft of the gear box 43 extends through an opening in the upper central portion of the first pin support portion 29 for connection with the drive gear 44 which is located adjacent the front surface of the first pin support portion 29. The drive gear 44 is operatively connected to the boom 12 by the gear rack assembly 50.

The gear rack assembly 50 includes a gear rack 52 which is operatively connected to the boom 12 for actuating movement of the boom 12. The gear rack 52 has outwardly projecting teeth extending longitudinally from one end of the gear rack 52 to a distance short of the opposite end where a transverse hole is located. The opposite end of the gear rack 52 extends through an opening in one side of the boom 12 for attachment between opposite sides of the boom 12 using a nut and bolt passing through the transverse hole in the gear rack 52. A wear block 54 is attached to the boom 12 surrounding the opening through which the opposite end of the gear rack 52 extends and abuts the gear tooth adjacent the boom 12 to provide a wear surface for protection of the boom. A C-shaped guide block 56 is attached to the front surface of the first pin support portion 29 and straddles the drive gear 44 to provide a guide slot 58 through which the gear rack 52 reciprocates when driven by the drive gear 44. The drive gear 44 has radially extending teeth which engage the teeth of the gear rack 52. Actuation of the drive gear 44 by the gear drive motor 42 produces reciprocating movement of the rack gear 52 to move the boom 12 about the hinge pin 26 to raise or lower the boom 12 depending on the direction of rotation of the drive gear 44. Both the mounting block 54 and the guide block 56 are made of a suitable plastic material such as Delrin.

Figure 5:
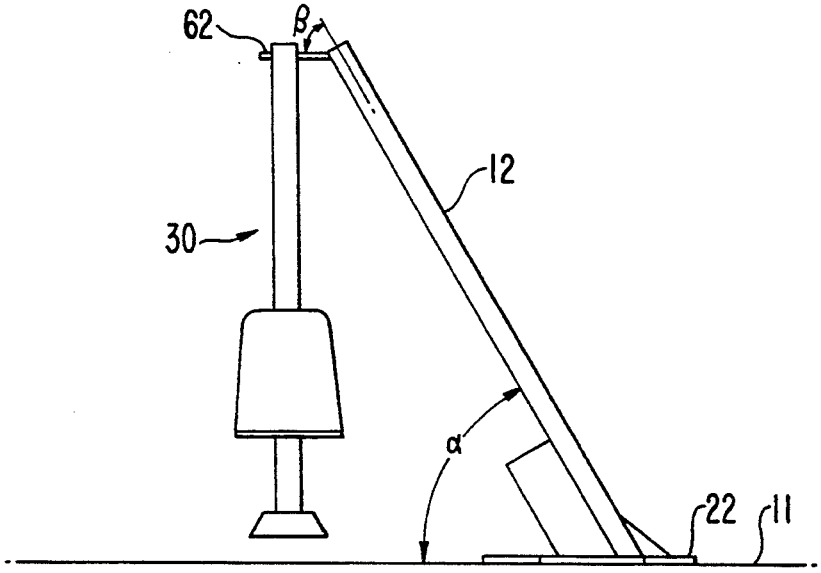
FIG. 5 is a schematic illustration of the passenger carrier suspended from the boom.
Figure 7:
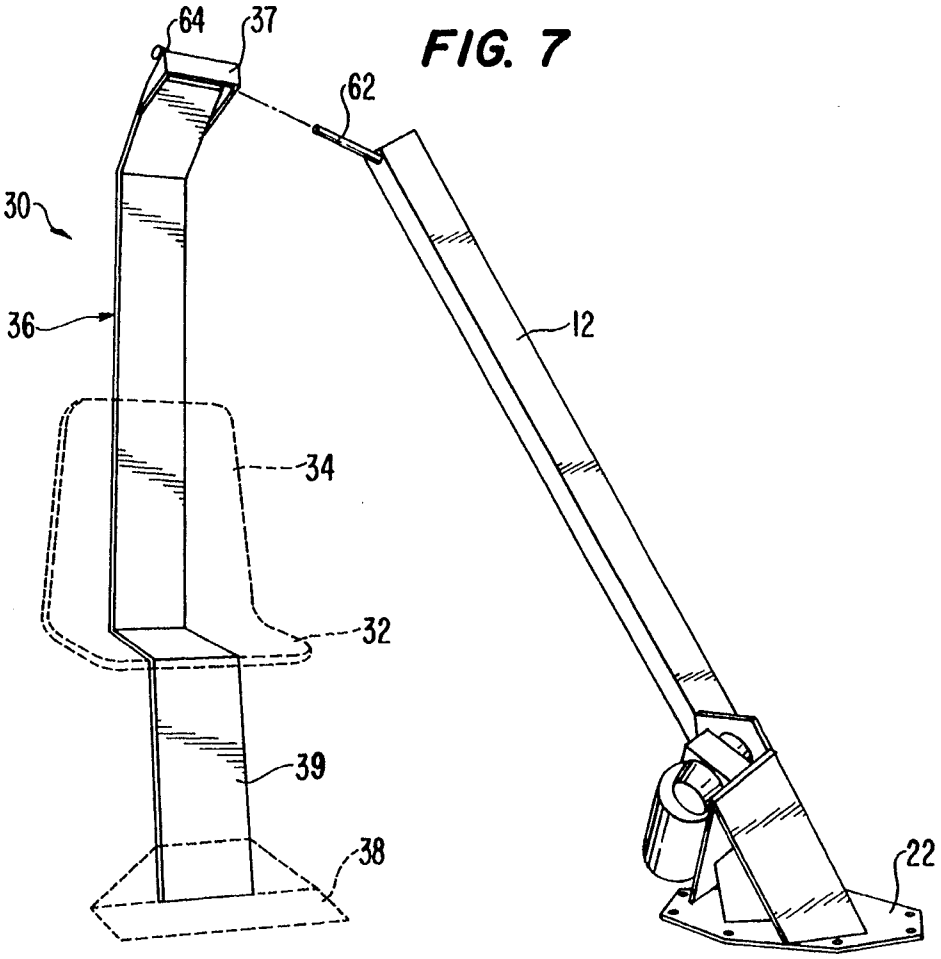
FIG. 7 is an exploded perspective view of the boom, mounting means and passenger carrier.
Figure 6:
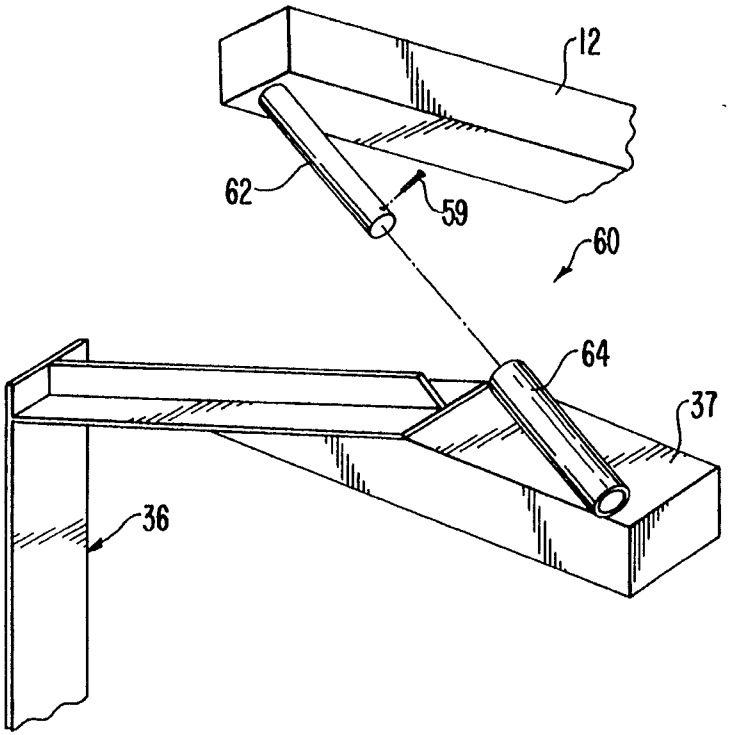
FIG. 6 is a fragmentary exploded perspective view of the suspension means for the passenger carrier.

As illustrated in FIGS. 6 and 7, the lift apparatus 10 also includes suspension means 60 connecting the carrier 30 and the boom 12 for suspending the seat 32 in a horizontal plane substantially parallel to the base 22 and to the pool deck 11. The suspension means 60 includes a pin or rod 62, which is fixed to and extends from the other end of the boom 12, and a hinge tube 64 which is fixed to the carrier 30, as described below, and has an inner diameter sized for reception of a nylon bushing (not shown) and the rod 62. With reference also to the schematic illustration of FIG. 5, the rod 62 extends at an angle $\beta$ to the longitudinal axis of the boom 12 so that the rod 62 is parallel to the base 22 and remains parallel to the base 22 as the boom 12 moves between the raised position over the pool deck 11 and the lower position over the pool 13. The angle $\beta$ which the rod 62 makes with the longitudinal axis of the boom 12 is 60°, as measured in a clockwise direction from the rod 62 to the longitudinal axis of the boom 12, when the boom 12 is mounted at an oblique angle of 60° to the base 22. The angle $\beta$ has the same magnitude as the oblique angle $\alpha$. So, in the case where the boom 12 is mounted at an oblique angle of 50°, the angle $\beta$ is likewise 50°

The carrier 30 also includes a frame 36 extending lengthwise along the rear surface of the backrest 34 and under the seat 32, and attached to the seat 32 by suitable fasteners. The frame 36 includes an extension member 37 which is located above and parallel to the seat 32 and extends lengthwise from the rear to the front of the seat 32. The hinge tube 64 is fixed to the extension member 37 at an angle of approximately 60°, as measured in a clockwise direction from the longitudinal center line of the extension member 37 to the axis of the hinge tube 64, so that the chair races generally forwardly with the passenger's back to the pool as the boom 12 moves from the raised position over the pool deck 11 to the lower position over the pool 13. The rod 62 extending from the boom 12 is rotatably received in the bushing which is captured within the hinge tube 64. A cotter pin 59 extends through a hole in the remote end of the rod 62. The suspension means 60 comprising the rotatably connected rod 62 and tube 64 thus allows the carrier 30 to swivel relative to the boom 12 so that the seat 32 remains generally in a horizontal plane parallel to the base 22 as the boom 12 pivots about the hinge pin 26 in moving between the raised and lower positions. A footrest 38 is attached by conventional fasteners to a leg extension 39 of the frame 36 for supporting the passenger's feet.

It should be understood that the carrier 30 remains substantially rigid when a person in a wheelchair enters the carrier, as is normally done, from the side of the seat 32. The suspension means 60 comprising the interconnected rod 62 and tube 64 resists any torsion of the carrier 30 thus providing a secure and safe entry to the seat 32 from a wheelchair. The seat 32 is at a vertical height of approximately 20 inches above the base 22 with the boom in the raised position over the pool deck 11. The boom 12 is approximately 76 inches long. The gear rack 52 is approximately 24 inches long and is secured to the boom 12 approximately 18 inches from the pivot point.

Figure 8:
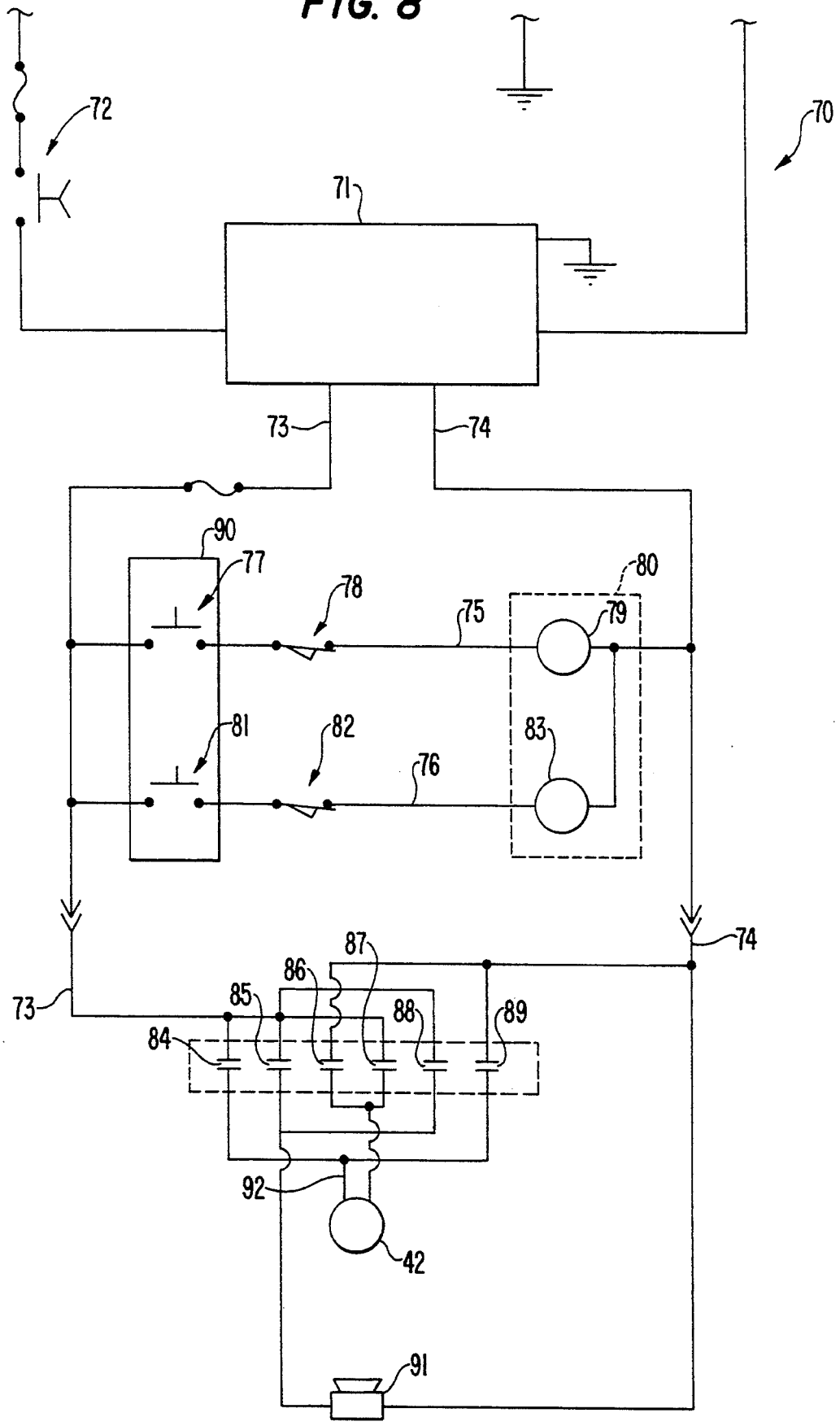
FIG. 8 is a schematic of the electrical control circuit.

An electrical control circuit 70 for the lift assembly 10 is shown schematically in FIG. 8. The control circuit 70 includes a 24 volt DC power supply 71 which converts a conventional 120 volt AC input from a pair of input lines to a 24 volt DC output for operating the gear drive motor 42. The 24 volt DC power supply 71 is available from Elpac Power Systems, model No. BF S500-24. The control circuit 70 includes an on/off switch 72 which controls the supply of AC power to the 24 volt DC power supply 71.

The output of the 24 volt DC power supply 71 is an unregulated 24 volts to positive and negative power lines 73 and 74. Parallel circuit lines 75 and 76 are connected between the positive and negative power lines 73 and 74 for controlling power to the gear drive motor 42. The circuit line 75 has a series connected normally open "up" pushbutton switch 77, a normally closed "up" limit switch 78, and a first coil 79 having associated relay contacts 84, 85, 86 of a reversing motor starter 80. The circuit line 76 has a series connected normally open "down" pushbutton switch 81, a normally closed "down" limit switch 82, and a second coil 83 having associated relay contacts 87, 88, 89 of the reversing motor starter 80. The limit switches and the reversing motor starter are available from Square D/Telemechanique part nos. XCK-P51 and LP2EC09B, respectively.

A remote control handset 90 is electrically connected over a multiconductor cable (not shown) to the control circuit 70 for manual operation, normally, by a person other than the passenger being transported into and out of the pool. The remote control handset 90 has an "up" pushbutton operator and a "down" pushbutton operator for selectively closing either the "up" switch 77 or the "down" switch 81 to raise or lower the boom 12. Both operators are spring biased to a retracted position so that continuous depression of the operator is necessary to maintain the switch closed. The pushbutton operators are available from Square D/Telemechanique, part nos. ZA2BA5/ZA2BZ101 (yellow button) and ZA2BA6/ZA2BZ101 (blue button).

With reference to FIG. 2, the normally closed "up" limit switch 78 is attached to the front surface of the first pin support portion 29 of the first bracket 25 at a position such that the boom 12 contacts the normally closed "up" limit switch 78 to open the switch 78 when the boom 12 moves to the raised position, thereby terminating power to the gear drive motor 42 to limit upward movement of the boom 12 to the raised position. The normally closed "down" limit switch 82 is attached to the front surface of the first pin support portion 29 at a position such that a limit switch flag 59, which is fixed to the free end of the gear rack 52, engages the normally closed "down" limit switch 82 to open the switch 82 when the boom 12 moves to the lower position, thereby terminating power to the gear drive motor 42 to limit downward movement of the boom 12 to the lower position. Thus, the "up" limit switch 78 and the "down" limit switch 82 comprise detection means for detecting when the boom 12 has moved either to the raised position or to the lower position for terminating power to the gear drive motor 42 at both the raised and lower positions, thereby limiting movement of the boom 12 between the raised and lower positions.

The following is an operational description of the present invention using the control circuit 70 to transport a passenger from a pool deck into and out of a swimming pool. With the boom 12 in the raised position over the pool deck 11 and the seat 32 at the first position above the deck 11, a passenger enters the carrier 30 and is supported by the seat 32. To lower the boom 12, the "down" pushbutton operator is held depressed to close the "down" switch 81 which allows power to flow in the circuit line 76 to energize the second coil 83 of the reversing motor starter 80. Energizing the second coil 83 closes the second coil relay contacts 87, 88 and 89 whereupon power is supplied from the negative power line 74 through the closed relay contact 89 to a line 92 which is connected to the gear drive motor 42 to rotate the drive gear 44 in a first direction to lower the boom 12. The boom 12 is lowered as long as the "down" pushbutton operator is held depressed until the "down" limit switch 82 is engaged at the lower position of the boom. Moving the boom 12 between the raised position over the deck 11 and the lower position over the pool 13 moves the seat 32 in the arc 35 between the first position above the deck 11 and the second position below the deck 11 so that the passenger enters the swimming pool 13. A horn 91 is supplied with power for emitting an audible sound as long as the relay contact 88 remains closed while power is being supplied to the gear drive motor 42. The horn 91 provides a warning signal that the lift apparatus 10 is in operation.

To raise the boom 12 and transport the passenger from the pool 13 to the deck 11, the "up" pushbutton operator is held depressed thereby closing the "up" switch 77 which allows power to flow in the circuit line 75 to energize the first coil 79 of the reversing motor starter 80 causing the first coil relay contacts 84, 85 and 86 to close. Consequently, power is supplied over the positive power line 73 through the closed relay contact 84 to the line 92 and to the gear drive motor 42 for energizing the motor to rotate the drive gear 44 in a second direction, opposite the first direction, to raise the boom 12. As the boom 12 moves from the lower position over the pool 13 to the raised position over the deck 11, the seat 32 moves in the arc 35 from the second position below the deck 11 to the first position above the deck 11. When the boom 12 has moved to the raised position, release of the "up" pushbutton operator or engagement of the "up" limit switch 78 terminates power to the gear drive motor 42 to stop movement of the boom 12 whereupon the passenger may exit the lift apparatus 10 onto the pool deck 11. As before, the horn 91 emits an audible sound as long as the relay contact 85 remains closed to supply power from the power line 73 to energize the horn.

Thus, the present invention provides a method of transporting a passenger into and out of a swimming pool from a generally horizontal pool deck including the steps of mounting the boom 12 at an oblique angle to the deck 11 and moving the boom 12 in an oblique plane between the raised position overlying the deck 11 and the lower position overlying the pool 13 to move the seat 32 in the arc 35 between the first position above the deck 11 and the second position below the deck 11 to transport the passenger between the pool deck 11 and the swimming pool 13.

The invention has been described in an illustrative manner, and it is to be understood that the terminology which has been used is intended to be in the nature of words of description rather than limitation. It is contemplated that many modifications and variations of the present invention are possible in light of the above teachings. It is, therefore, to be understood that, within the scope of the appended claims, the invention may be practiced otherwise than as specifically described. It is intended that the above specification be considered as exemplary only, with a true scope and spirit of the invention being indicated by the following claims.

What is claimed is:

1. A lift apparatus for transporting a passenger between positions, the lift apparatus comprising:

a boom;

means for mounting said boom for pivoting movement in a plane oblique to a horizontal plane between a raised position and a lower position, said mounting means having a base;

a carrier suspended from said boom at a point spaced from said mounting means and having a seat for supporting the passenger, said seat being at a first position above the base when said boom is in the raised position and at a second position below the base when said boom is in the lower position; and drive means for reversibly moving said boom in the oblique plane between the raised and lower positions to move said seat in an arc between the first and second positions.

2. The lift apparatus of claim 1, wherein the oblique plane extends at an oblique angle to the horizontal plane and said mounting means includes a hinge fixed to the base, said hinge having a pin defining with the horizontal plane an angle which is complementary to the oblique angle, whereby said pin serves as a pivot for said boom.

3. The lift apparatus of claim 2, wherein the oblique angle is 60°.

4. The lift apparatus of claim 2, wherein said hinge includes opposed, spaced-apart pin support portions extending upwardly from the base at the same angle as the oblique angle, said pin being secured in said pin support portions.

5. The lift apparatus of claim 1, wherein said drive means comprises a gear drive motor and a drive gear operatively connected to the gear drive motor.

6. The lift apparatus of claim 5, further comprising a gear rack operatively connected to said boom for actuating movement of said boom, said drive gear engaging said gear rack.

7. The lift apparatus of claim 1, further comprising suspension means connecting said carrier and said boom for suspending said seat in a horizontal plane.

8. The lift apparatus of claim 7, wherein said carrier includes a frame attached under said seat and having an extension member extending generally horizontally above said seat, and wherein said suspension means comprises a rod fixed to and extending front said boom at an angle to a longitudinal axis of said boom, a tube fixed to said extension member and having an inner diameter sized for reception of said rod, said rod being rotatably received within said tube to permit swiveling of said carrier relative to said boom as said boom moves between the raised and lower positions.

9. The lift apparatus of claim 8, wherein the oblique plane extends at an oblique angle to the horizontal plane and said rod angle has the same magnitude as the oblique angle.

10. The lift apparatus of claim 1, wherein said carrier includes a backrest projecting upwardly front said seat for supporting the passenger in a sitting position, a frame extending lengthwise along the rear surface of said backrest and under said seat and attached to said seat, said frame having an extension member extending generally horizontally above said seat and being connected to said boom.

11. The lift apparatus of claim 5, further comprising an electrical control circuit connected to said gear drive motor for supplying power to the motor.

12. The lift apparatus of claim 11, wherein said circuit includes manually operated switch means for controlling power to said gear drive motor to selectively raise and lower said boom.

13. The lift apparatus of claim 11, wherein said circuit includes detection means for detecting movement of said boom either to the raised position or to the lower position for terminating power to said gear drive motor at both said raised and lower positions, thereby limiting movement of said boom between the raised and lower positions.

14. The lift apparatus of claim 11, wherein said circuit includes an audible sounding device for emitting an audible sound when power is supplied to said gear drive motor.

15. In a lift apparatus having a carrier for transporting a passenger between a first position and a second position in relation to a horizontal reference plane, and a boom movable between a raised position and a lower position corresponding, respectively, to the carrier being at the first position and at the second position, the carrier being suspended from the boom, the improvement comprising:

means for mounting the boom for pivoting movement in a plane oblique to the horizontal reference plane so that the boom is movable in the oblique plane between the raised and lower positions to move the carrier in an arc between the first position and the second position.

16. The lift apparatus of claim 15, further comprising drive means operatively connected to the boom for reversibly moving the boom between the raised and lower positions.

17. The lift apparatus of claim 15, wherein the carrier has a seat for supporting the passenger, the lift apparatus further comprising suspension means connecting the carrier and the boom for suspending said seat parallel to the horizontal reference plane.

18. A method of transporting a passenger into and out of a swimming pool front a generally horizontal pool deck, including a pivotally mounted boom having a raised position overlying the pool deck and a lower position overlying the pool, a carrier suspended from the boom, said carrier having a seat for supporting the passenger, the seat being at a first position above the deck with the boom in the raised position and at a second position below the deck with the boom in the lower position, the method comprising the steps of:

mounting the boom at an oblique angle to the deck for pivotal movement in an oblique plane between the raised and lower positions; and moving the boom in the oblique plane between the raised position overlying the deck and the lower position overlying the pool to move the seat in an arc between the first position above the deck and the second position below the deck to transport the passenger between the pool deck and the swimming pool.

19. The method of claim 18, further comprising the step of suspending the seat in a horizontal plane, wherein the seat remains generally parallel to the pool deck as the seat moves between the first and second positions.

20. The method of claim 18, further comprising the step of driving a gear engaging a gear rack which is operatively connected to the boom to move the boom between the raised and lower positions.

* * * * *